US011060232B2

(12) United States Patent
Kim et al.

(10) Patent No.: US 11,060,232 B2
(45) Date of Patent: Jul. 13, 2021

(54) LAUNDRY TREATMENT APPARATUS AND METHOD OF CONTROLLING THE SAME

(71) Applicant: LG Electronics Inc., Seoul (KR)

(72) Inventors: Woore Kim, Seoul (KR); Changoh Kim, Seoul (KR); Sangwook Hong, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/111,492

(22) Filed: Aug. 24, 2018

(65) Prior Publication Data

US 2019/0062981 A1 Feb. 28, 2019

(30) Foreign Application Priority Data

Aug. 25, 2017 (KR) ..... 10-2017-0108223

(51) Int. Cl.

| | |
|---|---|
| ***D06F 39/04*** | (2006.01) |
| ***D06F 33/00*** | (2020.01) |
| ***H05B 6/06*** | (2006.01) |
| ***H05B 6/10*** | (2006.01) |
| *D06F 58/26* | (2006.01) |

(52) U.S. Cl.

CPC ..... *D06F 39/045* (2013.01); *D06F 33/00* (2013.01); *H05B 6/06* (2013.01); *H05B 6/108* (2013.01); *D06F 58/26* (2013.01); *D06F 2202/02* (2013.01); *D06F 2202/04* (2013.01); *D06F 2202/065* (2013.01); *D06F 2204/04* (2013.01)

(58) Field of Classification Search

CPC ..... D06F 39/04

See application file for complete search history.

(56) References Cited

FOREIGN PATENT DOCUMENTS

| | | | |
|---|---|---|---|
| DE | 102009026646 | 12/2010 | |
| DE | 102016110859 | 6/2017 | |
| EP | 2400052 | 12/2011 | |
| EP | 3287559 A1 * | 2/2018 | ..... D06F 37/04 |
| JP | S6158694 | 3/1986 | |

OTHER PUBLICATIONS

European Search Report in European Application No. 18188199.6, dated Dec. 19, 2018, 8 pages.

* cited by examiner

*Primary Examiner* — Jason Y Ko
(74) *Attorney, Agent, or Firm* — Fish & Richardson P.C.

(57) ABSTRACT

Disclosed is a laundry treatment apparatus, which directly heats a drum accommodating laundry and is enhanced in efficiency and safety. The laundry treatment apparatus includes a tub, a drum formed of a metal material and rotatably provided inside the tub to accommodate laundry, an induction module spaced apart from a circumferential surface of the drum to heat the circumferential surface of the drum via a magnetic field that is generated when current is applied to a coil, a lifter provided in the drum to move the laundry inside the drum when the drum rotates, a temperature sensor provided to sense a temperature of the drum, and a module controller configured to control an output of the induction module so as to control an amount of heat generated from the circumferential surface of the drum. The module controller controls the amount of heat based on the temperature sensed by the sensor.

27 Claims, 11 Drawing Sheets

LAUNDRY TREATMENT APPARATUS AND METHOD OF CONTROLLING THE SAME

CROSS-REFERENCE TO RELATED APPLICATION

This application claims the benefit of Korean Patent Application No. 10-2017-0108223, filed on Aug. 25, 2017, which is hereby incorporated by reference as if fully set forth herein.

BACKGROUND OF THE INVENTION

Field of the Invention

The present invention relates to a laundry treatment apparatus, which directly heats a drum accommodating laundry therein, and which is enhanced in efficiency and safety.

Discussion of the Related Art

A laundry treatment apparatus is an apparatus for treating laundry and has functions to wash, dry, and refresh laundry.

There are various types of laundry treatment apparatuses, such as a washing machine that is mainly for washing laundry, a washing machine that is mainly for drying, and a refresher that is mainly for refreshing.

Then, there is a laundry treatment apparatus capable of performing at least two laundry treatments among washing, drying, and refreshing. For example, a single washing and drying machine may perform all of washing, drying, and refreshing.

In recent years, there has been provided a laundry treatment apparatus that incorporates two treatment apparatuses so that the two treatment apparatuses perform washing at the same time, or perform washing and drying at the same time.

The laundry treatment apparatus may generally include a heating device that heats wash water or air. Heating of the wash water may be performed to raise the temperature of wash water so as to promote activation of a detergent and accelerate decomposition of contaminants, thereby enhancing washing performance. Heating of the air may be performed to dry wet laundry by applying heat to the wet laundry so as to evaporate moisture.

In general, the heating of the wash water is performed via an electric heater, which is mounted on a tub in which the wash water is accommodated. The electric heater is immersed in the wash water, and the wash water includes foreign substances and detergents. Therefore, foreign substances, such as scale, may accumulate on the electric heater, which may degrade the performance of the electric heater.

In addition, the heating of the air requires a separate element, such as a fan for forcibly generating movement of the air and a duct for guiding the movement of the air. For example, an electric heater or a gas heater may be used for heating the air. In general, the efficiency of such an air heating method is not high.

In recent years, there has been provided a drying machine for heating air using a heat pump. The heat pump utilizes the cooling cycle of an air conditioner in reverse, and thus requires the same elements as those of an air conditioner, namely an evaporator, a condenser, an expansion valve, and a compressor. Unlike the air conditioner in which a condenser is used in an indoor unit to lower the temperature of indoor air, the drying machine using the heat pump is configured to dry laundry by heating air in an evaporator.

However, such a drying machine using the heat pump has a complicated configuration and increased manufacturing costs, which is problematic.

In such a variety of laundry treatment apparatuses, an electric heater, a gas heater, and a heat pump, which serve as a heating device, have advantages and disadvantages, respectively, and concepts for a laundry treatment apparatus that uses induction heating as a new heating method capable of further highlighting the advantages of the aforementioned devices and compensating for the disadvantages thereof have been provided (Japanese Patent Registration No. JP2001070689 and Korean Patent Registration No. KR10-922986).

However, the related art discloses only basic concepts for performing induction heating in a washing machine, and does not propose specific constituent elements of an induction heating module, connections or operational relationships with basic constituent elements of the laundry treatment apparatus, or specific methods and configurations for enhancing efficiency and securing safety.

Therefore, it is necessary to provide a variety of specific technical ideas for enhancing efficiency and securing safety of the laundry treatment apparatus to which an induction heating principle is applied.

In addition, it may be necessary to provide a structure, elements, and control logic for preventing overheating because heating is performed.

SUMMARY OF THE INVENTION

Accordingly, the present invention is directed to a laundry treatment apparatus and a method of controlling the same that substantially obviate one or more problems due to limitations and disadvantages of the related art.

It is an object of the present invention to provide a laundry treatment apparatus that is enhanced in efficiency and safety while using induction heating and a method of controlling the same.

According to an embodiment of the present invention, it is an object to provide a laundry treatment apparatus that effectively prevents overheating from occurring in a lifter provided in a drum, thereby enhancing safety and a method of controlling the same. In particular, it is an object to provide a laundry treatment apparatus that faithfully maintains the basic functions of a lifter and enhances stability and a method of controlling the same.

According to an embodiment of the present invention, it is an object to provide a laundry treatment apparatus that is capable of preventing overheating from occurring in a portion of a drum in which a lifter is mounted without changing the shapes of the drum and the lifter and a method of controlling the same.

According to an embodiment of the present invention, it is an object to provide a laundry treatment apparatus that is capable of grasping the position of a lifter and reducing the amount of heat generated in a portion of the circumferential surface of a drum corresponding to the lifter, thereby reducing energy loss and preventing breakage of the lifter and a method of controlling the same.

According to an embodiment of the present invention, it is an object to provide a laundry treatment apparatus that is capable of preventing overheating of a drum by heating the drum when heat may be sufficiently transferred from the drum to wash water or laundry and a method of controlling the same.

According to an embodiment of the present invention, it is an object to provide a laundry treatment apparatus that is capable of preventing unintended overheating of a drum by reliably sensing the temperature of the drum that is being rotated and a method of controlling the same.

According to an embodiment of the present invention, it is an object to provide a laundry treatment apparatus equipped with a temperature sensor at a position at which the temperature of a drum may be optimally sensed with minimal influence from the external environment.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

To achieve these objects and other advantages in accordance with the purpose of the invention, as embodied and broadly described herein, in accordance with one aspect of the present invention, a laundry treatment apparatus includes a tub, a drum formed of a metal material and rotatably provided inside the tub to accommodate laundry therein, an induction module spaced apart from a circumferential surface of the drum and configured to heat the circumferential surface of the drum via a magnetic field that is generated when current is applied to a coil, a lifter provided in the drum to move the laundry inside the drum when the drum rotates, a temperature sensor provided to sense a temperature of the drum, and a module controller configured to control an output of the induction module so as to control an amount of heat generated from the circumferential surface of the drum, wherein the module controller controls the amount of heat based on the temperature sensed by the temperature sensor.

The temperature sensor may be provided on an inner peripheral surface of the tub to sense air temperature between the inner peripheral surface of the tub and an outer peripheral surface of the drum. The temperature sensor may not be in direct contact with the outer peripheral surface of the drum and may estimate the temperature of the outer peripheral surface of the drum in an indirect manner.

The induction module may be mounted over one of a first quadrant and a second quadrant of the tub or over the first quadrant and the second quadrant based on a transverse cross section of the tub.

The second quadrant of the tub may be formed with an airflow hole for air communication between an inside of the tub and an outside of the tub.

The temperature sensor may be spaced apart from the induction module by a predetermined angular distance in a clockwise direction. Thus, the temperature sensor may be located out of the influence of a magnetic field of the induction module.

The tub may be formed in a fourth quadrant with a duct hole for discharging or circulating air of the inside of the tub to the outside.

The tub may be formed in a third quadrant with a condensing port for supplying cooling water to the inside of the tub.

Hence, the temperature sensor may more accurately sense the temperature of the outer peripheral surface of the drum at a position between the tub and the drum in the state in which the influence of the external environment is excluded to the maximum extent.

The module controller may turn off driving of the induction module based on the temperature sensed by the temperature sensor when the temperature of the drum is greater than a threshold temperature.

The module controller may control the induction module so as to be driven when the drum starts to rotate and exceeds a threshold RPM.

The threshold RPM may be less than a tumbling RPM.

The module controller may differently control the amount of heat based on a change in the position of the lifter caused when the drum rotates.

The module controller may control the amount of heat generated in the drum so as to be greater at a position at which the lifter is not positioned to face the induction module than at a position at which the lifter is positioned to face the induction module.

The laundry treatment apparatus may include a magnet provided in the drum at a fixed position relative to the lifter and a sensor provided at a fixed position outside the drum to sense the position of the lifter by sensing a change in the position of the magnet when the drum rotates.

In order to achieve the objects described above, according to another aspect of the present invention, a method of controlling a laundry treatment apparatus including a tub, a drum formed of a metal material and rotatably provided inside the tub to accommodate laundry therein, an induction module spaced apart from a circumferential surface of the drum and configured to heat the circumferential surface of the drum via a magnetic field that is generated when current is applied to a coil, a lifter provided in the drum to move the laundry inside the drum when the drum rotates, a temperature sensor provided to sense a temperature of the drum, and a module controller configured to control an output of the induction module so as to control an amount of heat generated from the circumferential surface of the drum, includes operating the induction module, controlling, by the module controller, the induction module to generate a normal output, sensing the temperature of the drum via the temperature sensor, and reducing the output of the induction module by the module controller when the temperature of the drum is greater than a threshold temperature.

In the reducing, the output may be controlled so as to be less than the normal output, or is turned off.

The method may further include an RPM of the drum, and the controlling may be performed when the RPM of the drum is greater than a threshold RPM, and the reducing may be performed when the RPM of the drum is less than the threshold RPM.

The threshold RPM may be greater than 0 RPM and less than a tumbling RPM.

The method may further include sensing a position of the lifter, and the laundry treatment apparatus may include a sensor provided in the tub to sense the position of the lifter or a main controller configured to estimate the position of the lifter based on a change in the power of the induction module.

When it is sensed that the position of the lifter faces the induction module, the reducing may be performed.

In order to achieve the objects described above, according to a further aspect of the present invention, a method of controlling a laundry treatment apparatus including a tub, a drum formed of a metal material and rotatably provided inside the tub to accommodate laundry therein, an induction module spaced apart from a circumferential surface of the drum and configured to heat the circumferential surface of the drum via a magnetic field generated when current is applied to a coil, a lifter provided in the drum to move the laundry inside the drum when the drum rotates, a temperature sensor provided to sense a temperature of the drum, and a module controller configured to control an output of the induction module so as to control an amount of heat generated from the circumferential surface of the drum, includes operating the induction module, stopping an operation of the induction module, determining whether to operate the induction module or to stop the operation of the induction module according to a rotational speed of the drum, and determining whether to operate the induction module or to stop the operation of the induction module according to the temperature of the drum.

Features in each of the above-described embodiments may be implemented in a combined manner in other embodiments as long as they are not contradictory or exclusive of each other.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE INVENTION

Hereinafter, exemplary embodiments of the present invention will be described in detail with reference to the accompanying drawings.

The basic constituent elements of a laundry treatment apparatus and an induction heating principle, which are applicable to an embodiment of the present invention, will be described below with reference to FIGS. 1 and 2.

Figure 1:
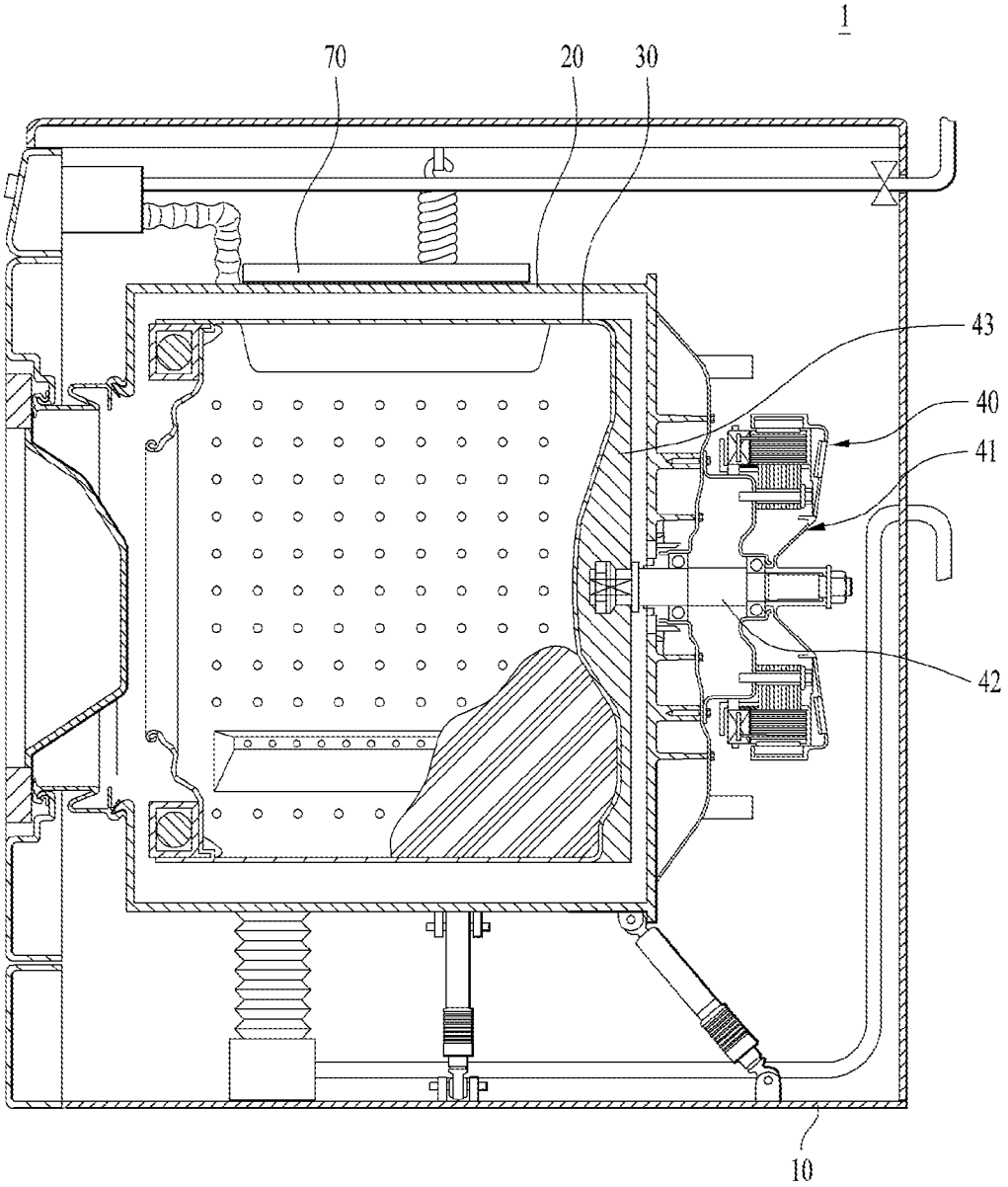
FIG. 1 illustrates a laundry treatment apparatus according to an embodiment of the present invention.

As illustrated in FIG. 1, the laundry treatment apparatus according to an embodiment of the present invention may include a cabinet 10, a tub 20, a drum 30, and an induction module 70 provided to heat the drum 30.

The tub 20 may be provided inside the cabinet 10 to accommodate the drum 30 therein. An opening may be provided in the front of the tub 20. The drum 30 is rotatably provided inside the tub 20 to accommodate laundry therein. Similarly, an opening may be provided in the front of the drum 30. The laundry may be introduced into the drum 30 through the openings in the tub 20 and the drum 30.

The induction module 70 may be provided to generate an electromagnetic field so as to heat the drum 30. The induction module 70 may be provided on the outer peripheral surface of the tub 20.

The tub 20 and the drum 30 may be formed to have a cylindrical shape. As such, the inner and outer peripheral surfaces of the tub 20 and the drum 30 may be formed to have a substantially cylindrical shape. FIG. 1 illustrates a laundry treatment apparatus in which the drum 30 is shaped to rotate about a rotation axis that is parallel to the floor.

The laundry treatment apparatus may further include a drive unit 40 provided to rotate the drum 30 inside the tub 20. The drive unit 40 includes a motor 41, which includes a stator and a rotor. The rotor may be connected to a rotating shaft 42 and the rotating shaft 42 is connected to the drum 30 to rotate the drum 30 inside the tub 20. The drive unit 40 may further include a spider 43. The spider 43 serves to interconnect the drum 30 and the rotating shaft 42 in order to secure that the rotational force of the rotating shaft 42 is uniformly and stably transmitted to the drum 30.

The spider 43 is coupled to the drum 30 in a manner such that at least a portion thereof is inserted into the rear wall of the drum 30. To this end, the rear wall of the drum 30 is recessed into the drum. The spider 43 may be further inserted into the drum 30 in the portion of the drum 30 corresponding to the rotational center thereof. Therefore, no laundry may be accommodated at the rear end portion of the drum 30 due to the spider 43.

A lifter 50 may be provided in the drum 30. Specifically, a plurality of lifters 50 may be provided in the circumferential direction of the drum 30. The lifter 50 functions to agitate the laundry. For example, the lifter 50 lifts the laundry upwards when the drum rotates. The upwardly moved laundry is separated from the lifter 50 and falls down due to gravity. The laundry may be washed by an impact force caused by the falling of the laundry. Such agitation of the laundry may enhance drying efficiency.

The laundry may be evenly distributed in the longitudinal direction inside the drum 30. Thus, the lifter 50 may be formed so as to extend from the rear end to the front end of the drum 30. For this reason, the lifter 50 may be necessary in a general drum type laundry treatment apparatus.

The lifter 50 differs from embossments on the drum. That is, the length by which the lifter 50 protrudes in the inward direction of the drum is much larger than the length of the embossments. In addition, unlike the embossments, the lifter 50 extends in the longitudinal direction of the drum 30.

The induction module 70 is a device that heats the drum 30.

Figure 2:
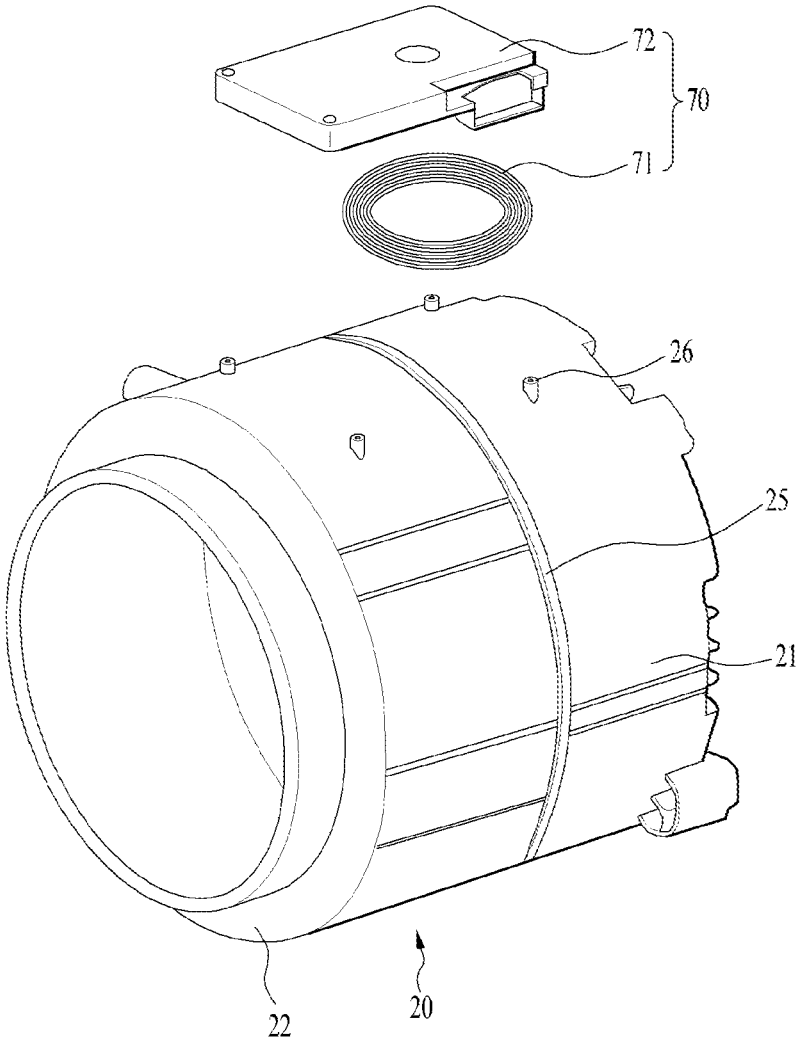
FIG. 2 illustrates the state in which an induction module is separated from a tub in the laundry treatment apparatus according to an embodiment of the present invention.

As illustrated in FIG. 2, the induction module 70 includes a coil 71, which is capable of generating eddy current in the drum 30 by generating a magnetic field upon receiving current, and a module cover 72, which accommodates the coil 71 therein.

The module cover 72 may include a ferromagnetic substance. The ferromagnetic substance may be a permanent magnet or a ferrite magnet. The module cover 72 may be provided so as to cover the top of the coil 71. As such, the ferromagnetic substance such as ferrite is positioned on the coil 71.

The coil 71 generates a magnetic field oriented toward the drum 30 located thereunder. Thus, the portion of the magnetic field above the coil 71 is not used for heating the drum 30. Therefore, the magnetic field may be concentrated on the lower side of the coil 71, rather than on the upper side of the coil 71. To this end, the ferromagnetic substrate such as ferrite may be provided above the coil 71 to concentrate the magnetic field on the lower side of the coil 71, i.e., on the drum 30. Of course, when the coil 71 is positioned below the tub 20, the ferromagnetic substance such as the ferrite is located below the coil 71. To summarize, it can be said that the coil 71 is located between the ferromagnetic substance and the drum 30.

Specifically, the module cover 72 may take the form of a box, one side of which is open. More specifically, the module cover 72 may take the form of a box having an open side that faces the drum 30 and a closed side opposite thereto. As such, the coil 71 may be positioned inside the module cover 72, or the module cover 72 may cover the top of the coil 71. The module cover 72 functions to protect the coil 71 from the outside. In addition, as will be described later, the module cover 72 functions to define an airflow space with the coil 71 so as to cool the coil 71.

In the laundry treatment apparatus, the coil 71 may heat the drum 30 to raise the temperature inside the drum 30 as well as the temperature of the drum 30. Thus, when the drum 30 is heated, the wash water in contact with the drum 30 may be heated, and the laundry in contact with the inner peripheral surface of the drum 30 may be heated. Of course, laundry that is not in contact with the inner peripheral surface of the drum 30 may also be heated by raising the temperature inside the drum 30. In this way, the temperatures of the wash water, the laundry, and the air inside the drum may be increased so as to improve washing effects, and the temperatures of the laundry, the drum, and the air inside the drum may be increased to dry the laundry.

Hereinafter, the principle of heating the drum 30 by the induction module 70 including the coil 71 will be described.

A wire is wound to form the coil 71, so that the coil 71 has a center.

When current is supplied to the wire, the current circularly flows about the center of the coil 71 due to the shape of the coil 71. Thereby, a magnetic field that perpendicularly passes through the center of the coil 71 is generated.

At this time, when alternating current having a varying phase difference passes through the coil 71, an alternating current magnetic field is formed so that the direction thereof changes as time passes. The alternating current magnetic field generates an induced magnetic field in a direction opposite to that thereof in an adjacent conductor, and a change in the induced magnetic field generates induced current in the conductor.

The induced current and the induced magnetic field may be understood to have a form of inertia with respect to a change in an electric field and a magnetic field.

When the drum 30 is provided as the conductor, eddy current as a type of induced current is generated in the drum 30 due to the induced magnetic field generated in the coil 71.

At this time, the eddy current is dissipated and converted into heat due to the resistance of the drum 30 as the conductor. As a result, the drum 30 is heated by heat generated by the resistance, and the temperature inside the drum 30 rises as the heating of the drum 30 proceeds.

In other words, when the drum 30 is configured as a conductor formed of a magnetic material such as iron (Fe), the drum 30 may be heated by the alternating current of the coil 71 provided on the tub 20. Recently, a stainless steel drum has frequently been used to improve the strength and hygiene of the drum. A stainless steel material may be easily heated by a change in an electromagnetic field because of the relatively good electrical conductivity thereof. This means that there is no need to specially manufacture the drum to have a new shape or using a new material in order to heat the drum via the induction module 70. Accordingly, a drum used in a conventional laundry treatment apparatus, such as a laundry treatment apparatus using a heat pump or a laundry treatment apparatus using an electric heater (sheath heater), may be used in the laundry treatment apparatus using the induction module.

The induction module 70, including the coil 71 and the module cover 72, may be provided on the inner peripheral surface of the tub 20. Since the intensity of a magnetic field decreases with increasing distance from the center of the magnetic field, the induction module may be provided on the inner peripheral surface of the tub 20 so as to reduce the distance to the drum 30.

However, since the tub 20 accommodates the wash water therein and the drum 30 vibrates while rotating, the induction module 70 may be provided on the outer peripheral surface of the tub 20 for safety. This is because the inside of the tub 20 is very humid, which may be undesirable for the insulation and stability of the coil 71. Therefore, the induction module 70 may be provided on the outer peripheral surface of the tub 20, as illustrated in FIGS. 1 and 2.

In the laundry treatment apparatus, generally, the tub 20 has a cylindrical shape because the drum 30 rotates to wash or dry laundry.

Here, the coil 71 may be wound around the entire circumferential surface of the tub 20 at least once.

However, when the coil 71 is wound around the entire circumferential surface of the tub 20, an excessively large amount of the coil 71 may be required, and the coil 71 may come into contact with the wash water flowing out from the tub 20, which may cause an accident such as a short-circuit.

In addition, when the coil 71 is wound around the entire circumferential surface of the tub 20, the induced magnetic field is generated in the opening 22 and the drive unit 40 of the tub 20, which may make it impossible to directly heat the outer peripheral surface of the drum 30.

Therefore, the coil 71 may be provided on the outer peripheral surface of the tub 20 only at one side of the outer peripheral surface of the tub 20. That is, the coil 71 may not be wound around the entire outer peripheral surface of the tub 20, but may be wound at least once in a predetermined area from the front to the rear of the tub 20.

This is in consideration of the efficiency of the output of the induction module 70 versus the heat generated in the drum 30. In addition, this serves to increase the manufacturing efficiency of the entire laundry treatment apparatus in consideration of the limited space between the tub 20 and the cabinet 10.

In addition, the coil 71 may be formed as a single layer. That is, the wire may be wound in a single layer, rather than being wound in multiple layers. When the wire is wound in multiple layers, a gap may be generated between the layers of the wire. Therefore, the uppermost layer and the lowermost layer of the wire may have therebetween a distance corresponding to the gap. This may increase the distance between the uppermost or lowermost layer of the coil and the drum. Of course, even if such a gap may be physically prevented, efficiency may be deteriorated as the distance between the uppermost or lowermost layer of the coil and the drum increases.

Accordingly, the coil 71 may be formed as a single layer. This also means that it is possible to increase the area of the coil 71 that is in contact with the drum 30 as much as possible while using the same length of wire.

In FIG. 1, the induction module 70 is illustrated as being provided on the upper portion of the tub 20, but the present invention does not exclude a configuration in which the induction module is provided on at least one of the upper portion, the lower portion, and both lateral portions of the tub. As will be described below, the induction module may be biased to the upper portion of the tub 20 and to the left or right side of the upper portion. When dividing the transverse cross section of the tub 20 into four quadrants, the induction module 70 may be provided in a first quadrant 1S or a second quadrant 2S, or may be provided over the first quadrant 1S and the second quadrant 2S. In either case, the induction module 70 may be located in the upper portion of the tub 20.

The induction module 70 may be provided on one side of the outer peripheral surface of the tub 20, and the coil 71 may be wound at least once along the surface of the induction module 70 adjacent to the tub 20 inside the induction module 70.

As such, the induction module 70 may directly radiate an induced magnetic field to the outer peripheral surface of the drum 30 to generate an eddy current in the drum 30, and as a result, may directly heat the outer peripheral surface of the drum 30.

Although not illustrated, the induction module 70 may be connected to an external power supply source through an electric wire to receive power, or may be connected to a controller, which controls the operation of the laundry treatment apparatus, to receive power. In addition, a module controller may be separately provided to control the output of the induction module 70. Thus, the module controller may control the on/off operation and the output of the induction module 70 under the control of the controller.

That is, the induction module may receive power from any place as long as it is capable of supplying power to the coil 71 therein.

When power is supplied to the induction module 70 so that alternating current flows in the coil 71 provided inside the induction module 70, the drum 30 is heated.

At this time, since only one side of the drum 30 is heated when the drum 30 is not rotated, the corresponding side may be overheated and the other side of the drum 30 may not be heated or may be insufficiently heated. In addition, heat may not be smoothly supplied to laundry accommodated in the drum 30.

Accordingly, when the induction module 70 is operated, the drive unit 40 may be rotated to rotate the drum 30.

The speed at which the drive unit 40 rotates the drum 30 may be any speed as long as the entire outer peripheral surface of the drum 30 faces the induction module 70.

As the drum 30 rotates, the entire outer peripheral surface of the drum 30 may be heated, and the laundry in the drum 30 may be evenly exposed to heat.

Thereby, in the laundry treatment apparatus according to the embodiment of the present invention, even if the induction module 70 is provided on only one place, rather than being provided on the upper portion, the lower portion, and both lateral portions of the outer peripheral surface of the tub 20, the outer peripheral surface of the drum 30 may be evenly heated.

In the laundry treatment apparatus according to the embodiment of the present invention, the drum 30 may be heated to 120 degrees Celsius or more within a very short time by driving the induction module 70. When the induction module 70 is driven in the state in which the drum 30 stops or is rotated at a very low rotational speed, a specific portion of the drum 30 may be overheated very quickly. This is because heat is not sufficiently transferred from the heated drum to the laundry.

Accordingly, it can be said that the relationship between the rotational speed of the drum 30 and the driving of the induction module 70 is very important. In addition, it may be desirable to rotate the drum first, followed by driving the induction module, rather to first drive the induction module and rotate the drum.

Details of the rotational speed of the drum and the driving control of the induction module will be described later.

As illustrated in FIG. 1, the lifter 50 is mounted on the longitudinal central portion of the drum 30 so as to extend in the longitudinal direction. In addition, a plurality of lifters 50 may be provided in the circumferential direction of the drum 30. As illustrated, the position of the lifter 50 is similar to the position at which the induction module 70 is mounted. That is, a large portion of the lifter 50 may be positioned to face the induction module 70. Thus, the outer peripheral surface of a portion the drum 30, in which the lifter 50 is provided, may be heated by the induction module 70. The outer peripheral surface of the portion of the drum 30, in which the lifter 50 is provided, is not in direct contact with the laundry inside the drum 30. The heat generated in the outer peripheral surface of the drum 30 is transferred to the lifter 50, rather than being transferred to the laundry, because the lifter 50 comes into contact with the laundry. Therefore, overheating of the lifter 50 may occur, which is problematic. Concretely, overheating of the drum circumferential surface that is in contact with the lifter 50 may be problematic.

Figure 3:
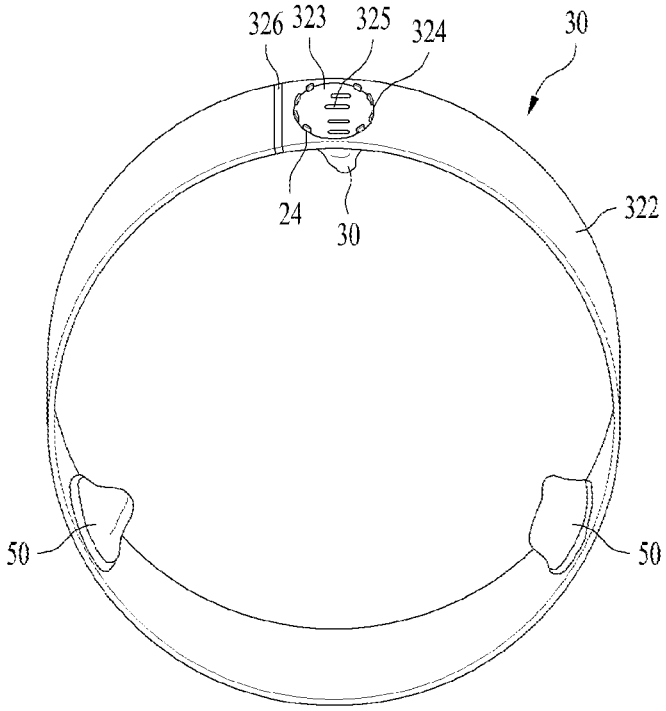
FIG. 3 illustrates a lifter mounted on a general drum.

FIG. 3 illustrates a general drum 30 and the lifter 50 mounted on the drum 30 according to the embodiment of the present invention. Only the drum center portion is illustrated, and front and rear portions of the drum 30 are omitted. This is because the lifter 50 may generally be mounted only on the drum center.

A plurality of lifters 50 are mounted in the circumferential direction of the drum 30. Here, three lifters 50 are mounted by way of example.

The circumferential surface of the drum 30 may be composed of a lifter mounting portion 323 in which the lifter 30 is mounted and a lifter exclusion portion 322 in which no lifter is mounted. The cylindrical drum 30 may be formed to have a seam portion 326 by rolling a metal plate. The seam portion 326 may be a portion at which both ends of the metal plate are connected to each other through welding or the like.

Various embossing patterns may be formed on the circumferential surface of the drum 30, and a plurality of through-holes 324 and lifter communication holes 325 may be formed for the mounting of the lifters 50. That is, various embossing patterns may be formed in the lifter exclusion portion 322, and the plurality of through-holes 324 and lifter communication holes 325 may be formed in the lifter mounting portion 323.

The lifter mounting portion 323 is a portion of the circumferential surface of the drum 30. Thus, in general, the lifter mounting portion 323 is formed with only a minimum number of holes for the mounting of the lifters and the passage of wash water. This is because, when a greater number of holes are formed through penetration or the like, manufacturing costs may unnecessarily increase.

Accordingly, the plurality of through-holes 324 may be formed in the lifter mounting portion 323 along the outer shape of the lifter 50 to be mounted, so that the lifter 50 may be coupled to the inner peripheral surface of the drum 30 via the through-holes 324. In addition, the plurality of lifter communication holes 325 may be formed in the central portion of the lifter mounting portion 323 so as to allow wash water to move from the outside of the drum 30 to the inside of the lifter 50.

However, it is general that only the necessary holes 324 and 325 are formed in the lifter mounting portion 323, and a large portion of the outer peripheral surface of the drum 30 is maintained as it is. That is, the total area of the holes 324 and 325 is smaller than the total area of the lifter mounting portion 323. Thus, a large area of the lifter mounting portion 323 excluding the area of the holes may directly face the induction module 70, and the lifter mounting portion 323 may be heated by the induction module 70.

The lifter 50 is mounted in the lifter mounting portion 323 so as to protrude inwards in the radial direction of the drum 30. As such, the lifter mounting portion 323 does not contact with the laundry inside the drum 20, and the lifter 50 comes into contact with the drum 30.

The lifter 50 may be generally formed of a plastic material. Since the plastic lifter 50 comes into direct contact with the lifter mounting portion 323, the heat generated in the lifter mounting portion 323 may be transferred to the lifter 50. However, the lifter 50 formed of a plastic material may transfer a very small amount of heat to the laundry that comes into contact with the lifter 50. This is because the plastic material of the lifter 50 has a very low heat transfer characteristic. Therefore, only a portion of the lifter 50 that is in contact with the lifter mounting portion 323 is exposed to a high temperature, and the heat is not transmitted to the entire lifter 50.

According to the results of experimentation performed by the inventors of the present invention, it could be found that the temperature at the lifter mounting portion may rise to 160 degrees Celsius, while the temperature at the portion in which no lifter is mounted may rise to 140 degrees Celsius. It may be considered that this is because the heat generated in the lifter mounting portion may not be transferred to the laundry.

Therefore, the lifter 50 may overheat, which may cause damage to the lifter 50. In addition, since the heat generated in the lifter mounting portion 323 may not be transferred to the laundry, energy may be wasted and heating efficiency may be lowered. The embodiments of the present invention are devised to overcome these problems.

Figure 4:
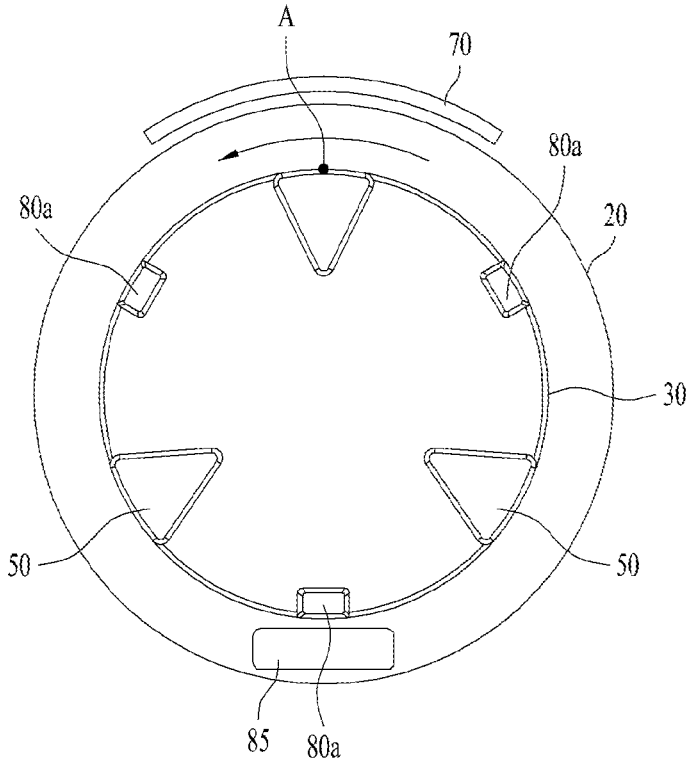
FIG. 4 schematically illustrates the configuration of the laundry treatment apparatus according to an embodiment of the present invention.

FIG. 4 is a simplified conceptual diagram of components according to an embodiment of the present invention.

As illustrated in FIG. 4, in the present embodiment, similarly, the drum 30 is heated via the induction module 70. In addition, similarly, the lifter 50 is mounted inside the drum 30. In addition, the induction module 70 may be mounted radially outside the drum 30, more specifically, on the outer peripheral surface of the tub 20, in the same manner as or similarly to the above-described embodiments.

The present embodiment has a feature in that current applied to the induction module 70 or the output of the induction module 70 may be varied when the rotation angle of the drum 30 is known. Specifically, since the drum 30 may be formed in a cylindrical shape, the rotation angle of the drum 30 may be defined as ranging from 0 degrees to 360 degrees about a specific point.

For example, the rotation angle of the drum at point A at which a specific lifter is at the uppermost portion may be defined as 0 degrees. Assuming that the drum rotates in the counterclockwise direction and that three lifters are equidistantly spaced apart from one another in the circumferential direction of the drum, it can be said that the lifters are located respectively at positions at which the rotation angle of the drum is 0 degree, at which the rotation angle of the drum is 120 degrees, and at which the rotation angle of the drum is 240 degrees. Considering the transverse width of the lifter, it can be said that the lifter is located in an angular range of approximately 2-10 degrees.

According to the present embodiment, it is possible to vary the amount of heating of the drum (hereinafter referred to as "drum heating amount") by the induction module 70 by grasping the position of the lifter 50 when the drum 30 rotates. That is, when the lifter 50 is located so as to face the induction module 70, the drum heating amount by the induction module may be reduced or eliminated, and when the lifter 50 is moved so as not to face the induction module 70, the drum heating amount may be normal. Changing the drum heating amount in this way may be realized by changing the output of the induction module 70.

Therefore, energy efficiency may be improved because the energy consumed in the induction module 70 is not consistent regardless of the rotation angle of the drum 30. In addition, since the energy consumed in the portion of the drum that corresponds to the lifter 50 may be significantly reduced, overheating in the lifter 50 may be remarkably reduced.

FIG. 4 illustrates permanent magnets 80*a* that are equidistantly provided in the circumferential direction of the drum 30, in the same manner as the lifters 50. The magnets 80*a* may be provided to effectively grasp the rotation angle of the drum 30. Similarly to the lifters 50, the magnets 80*a* may be equidistantly disposed in the circumferential direction. In addition, the magnets 80*a* may be provided in the same number as the lifters 50. Of course, the angle between the lifter 50 and the magnet 80*a* may be consistent between the plurality of lifters 50 and the plurality of magnets 80*a*.

Accordingly, when the position of a specific magnet 80*a* is sensed, the position of the lifter 50 associated with the specific magnet 80 may be sensed. Specifically, the positions of three lifters 50 may be sensed when the positions of three magnets 80*a* are sensed. When the magnet 80*a* is sensed at a specific position while the drum 30 rotates as illustrated in FIG. 4, it can be seen that the lifter 50 is located at a position at which the drum 30 rotates further by about 60 degrees in the counterclockwise direction.

Specifically, in the present embodiment, a sensor 85 may be further provided to sense the position of the lifter 50 by sensing the position of the magnet 80*a* when the drum 30 rotates. The sensor 85 may sense the position of the magnet 80*a* that corresponds to the rotation angle of the drum 30, and may sense the position of the lifter 50 based on the position of the magnet 80*a*.

Of course, the sensor 85 may merely detect whether or not the magnet 80*a* is present. The rotational speed of the drum 30 may be constant at a specific point in time, and thus, it can be seen that the lifter 50 reaches a position at which it faces the induction module 70 when a specific time has passed from the point in time at which the magnet 80*a* is sensed.

To put it easily, assuming that the drum rotates at 1 RPM, it can be said that the drum rotates 360 degrees in 60 seconds. Assuming that three magnets 80*a* and three lifters 50 are disposed at the same angular distance, it can be seen that the lifter 50 reaches the position at which it faces the sensor 85 after the drum further rotates by 60 degrees, i.e. 10 seconds after the point in time at which the sensor 85 senses a specific magnet 80*a*.

As illustrated in FIG. 4, it can be seen that any one lifter 50 is located to face the induction module 70 when the sensor 85 senses the magnet 80*a* located at the lowermost portion of the drum 30. Therefore, the drum heating amount by the induction module 70 may be reduced at the position at which the lifter 50 faces the induction module 70, and may be increased when the lifter 50 deviates from the position. For example, the output of the induction module 70 may be interrupted, or the output of the induction module 70 may be maintained at a normal level.

The magnet 80*a* may be disposed at the same position as the lifter 50, regardless of what is illustrated in FIG. 4. In this case, sensing the position of the magnet 80*a* may be the same as sensing the position of the lifter 50. However, in this case, it may be difficult to drive the induction module 70, which is of chief importance. Although it is possible to vary the output of the induction module 70 within a very short time, it is not easy to vary the output of the induction module 70 simultaneously with sensing of the magnet 80*a*. This is because the angular area occupied by the lifter 50 may be greater than the angular area occupied by the magnet 80*a*. The position of the magnet 80*a* may be defined by a specific angle, but the angle of the lifter 50 may be defined by a specific angular range, rather than a specific angle.

Therefore, in consideration of a time required to change the output and the angular area occupied by the lifter 50, the position of the magnet 80*a* may be circumferentially spaced apart from the lifter 50 by a predetermined angle in order to more accurately vary the output of the induction module 70. In addition, the acceptable delay time may change based on the drum RPM.

It is necessary for the magnet 80*a* to rotate together with the drum 30. Therefore, the magnet 80*a* may be provided on the drum 30. In addition, the sensor 85 for sensing the magnet 80*a* may be provided on the tub 20. That is, in the same manner as the manner in which the drum 30 rotates relative to the fixed tub 20, the magnet 80*a* may rotate relative to the fixed sensor 85.

Figure 5:
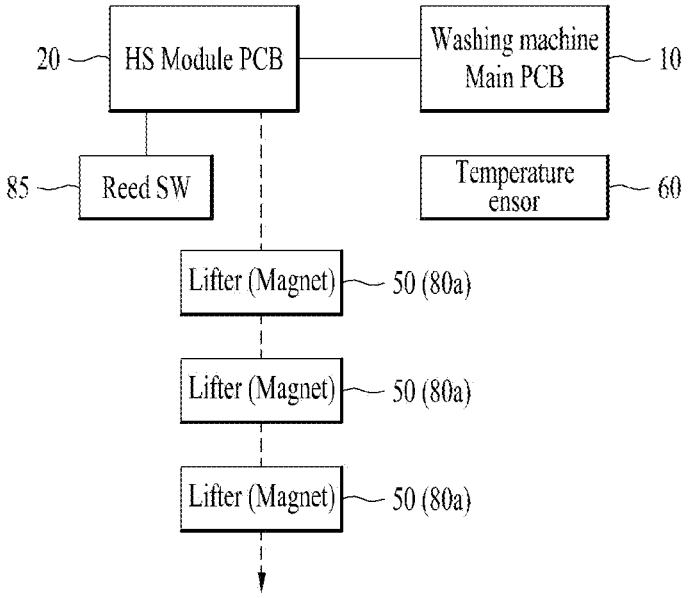
FIG. 5 is a block diagram of control elements that are applicable to FIG. 4.

FIG. 5 illustrates control elements for grasping the position of the lifter 50 by sensing the position of the magnet 80*a*.

A main controller 100 or a main processor of the laundry treatment apparatus controls various operations of the laundry treatment apparatus. For example, the main controller 100 controls whether or not to drive the drum 30 and the rotational speed of the drum. In addition, a module controller 200 may be provided to control the output of the induction module under the control of the main controller 100. The module controller may also be referred to as an induction heater (IH) controller or an induction system (IS) controller.

The module controller 200 may control the current applied to an induction drive unit, or may control the output of the induction module. For example, when the controller 100 issues a command to operate the induction module to the module controller 200, the module controller 200 may perform control so that the induction module operates. When the induction module is configured to be simply repeatedly turned on and off, a separate module controller 200 may not be required. For example, the induction module may be controlled so as to be turned on when the drum is driven and to be turned off when the drum stops.

However, in the present embodiment, the induction module may be controlled so as to be repeatedly turned on and off while the drum is being driven. That is, a point in time for control switching may very quickly change. Therefore, the module controller 200 may be provided to control the driving of the induction module, separately from the main controller 100. This also serves to reduce the burden of the processing capacity of the main controller 100.

The sensor 85 may be provided in various forms as long as it is capable of sensing the magnet 80*a* and transmitting the sensing result to the module controller 200.

The sensor 85 may be a reed switch. The reed switch is turned on when a magnetic force is applied by a magnet and is turned off when the magnetic force disappears. Thus, when the magnet is positioned as close as possible to the reed switch, the reed switch may be turned on due to the magnetic force of the magnet. Then, when the magnet becomes far away from the reed switch, the reed switch may be turned off. The reed switch outputs different signals or flags when turned on and off. For example, the reed switch may output a signal of 5V when turned on, and may output a signal of 0V when turned off. The module controller 200 may estimate the position of the lifter 50 by receiving these signals. Conversely, the reed switch may output a signal of 0V when turned on, and may output a signal of 0V when turned off. Since the period during which magnetic force is sensed is longer than the period during which no magnetic force is sensed, the reed switch may be configured to output a signal of 0V when detecting the magnetic force.

The module controller 200 may acquire information on the drum RPM via the main controller 100. Then, the module controller 200 may grasp the angle between the lifter 50 and the magnet 80*a*. Thus, the module controller 200 may estimate the position of the lifter 50 based on the signal of the reed switch 85. Of course, the module controller 200 may vary the output of the induction module based on the estimated position of the lifter 50. The module controller 200 may cause the output of the induction module to become zero or to be reduced at a position at which the lifter 50 faces the induction module. This may remarkably reduce unnecessary energy consumption in the portion in which the lifter 50 is mounted. Thereby, overheating in the portion in which the lifter 50 is mounted may be prevented.

The sensor 85 may be a hall sensor. The hall sensor may output different flags when sensing the magnet 80*a*. For example, the sensor 85 may output Flag "0" when sensing the magnet 80*a*, and may output Flag "1" when sensing no magnet.

In either case, the module controller 200 may estimate the position of the lifter 50 based on the magnet sensing signal. Then, the module controller 200 may variably control the output of the induction module based on the estimated position of the lifter 50.

On the other hand, the magnets may not be used in the same manner as the lifters. This is because the lifters may be disposed at the same interval from each other, and therefore, when the position of a specific lifter is detected, the positions of the other lifters may be estimated with high accuracy. That is, regardless of what is illustrated in FIG. 4, two of the three magnets may be omitted.

Generally, the main controller 100 of the washing machine is aware of the rotation angle of the drum and/or the rotation angle of the motor 41. Assuming that the motor 41 and the drum rotate integrally and that the rotation angle of the motor 41 is the same as the rotation angle of the drum, the positions of the three lifters may be grasped by grasping the position of one magnet.

For example, the drum may rotate at 1 RPM and the lifter may be located at a position at which the drum rotates by 60 degrees relative to one magnet. It can be seen that, when the sensor 85 senses the magnet 80*a*, the lifter is located at the position to which the drum further rotates by 60 degrees (i.e., the position to which the drum further rotates in 10 seconds). Similarly, it can be seen that a second lifter is located at a position corresponding to a point in time at which 10 seconds have passed, and that a third lifter is located at a position corresponding to a point in time at which 10 seconds have passed.

That is, the main controller 100 may grasp the positions of the three lifters based on information on one magnet sensed by the sensor 85. Thus, the main controller 100 may control the module controller 200 to variably control the output of the induction module based on the positions of the lifters 50.

In this way, according to the embodiments described above, the output of the induction module may be reduced or set to zero at a point in time at which the lifter faces the induction module or for a time period during which the drum rotates, and the normal output of the induction module may be maintained when the lifter deviates from the position or the range at which it faces the induction module.

Therefore, unnecessary energy waste and overheating in the portion in which the lifter 50 is mounted may be prevented. Of course, since a conventional drum and lifter may be used without modification, it can be said that the present invention is very economically advantageous.

It is to be noted that, in the embodiments described above with reference to FIGS. 4 to 6, a separate sensor and a separate magnet are necessary in order to grasp the positions of the lifters. Although the positions of the lifters may be grasped using any other type of sensor, the provision of a separate sensor for grasping the position of the lifter may be necessary in any case.

The separate sensor for grasping the position of the lifter may complicate the manufacture of the laundry treatment apparatus and may increase manufacturing costs. This is because a sensor or a magnet, which is unnecessary in a conventional laundry treatment apparatus, needs to be additionally provided. Moreover, the shape or structure of the tub or the drum also needs to be modified in order to accommodate such an additional component.

Hereinafter, embodiments that may achieve the above-described objects without requiring a separate sensor and a magnet will be described in detail.

Figure 7:
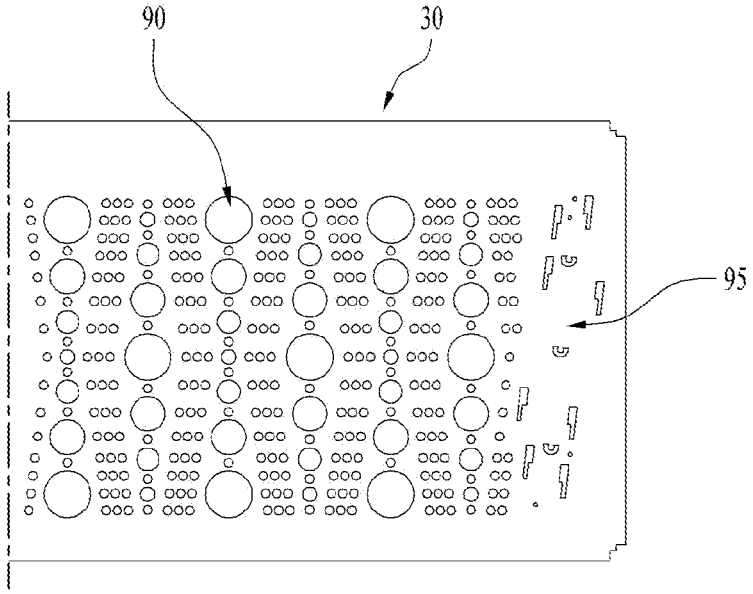
FIG. 7 illustrates an embodiment of the shape of the inner peripheral surface of a drum.

FIG. 7 illustrates a partial development view of the inner peripheral surface of the drum. As illustrated, various embossing patterns 90 may be formed on the inner peripheral surface of the drum. These embossments may be formed in various forms, such as convex embossments that protrude in the inward direction of the drum and convex embossments that protrude in the outward direction of the drum. The shape of the embossments may be selected from any of various shapes. It is to be noted that the embossing patterns are generally equally and repeatedly repeated in the circumferential direction of the drum.

As with the embossments, through-holes are generally formed in the drum and serve to allow wash water to move between the inside and the outside of the drum.

The embossing patterns 90 may be omitted in the portion of the circumferential surface of the drum in which the lifter is mounted. This is because the lifter may be easily mounted when the inner peripheral surface of the drum maintains a constant radius from the center of the drum. In other words, in the portion in which no lifter is mounted, the inner peripheral surface of the drum exhibits a great change in the radius thereof.

The embossments are formed such that a large portion thereof protrudes into the drum. That is, the area of the protruding portion is relatively large. This is because the area of the inner peripheral surface of the drum may increase due to the embossments that protrude into the drum, which may increase the frictional area between the laundry and the inner peripheral surface of the drum.

Assuming a drum having no embossments and having the same radius of the inner peripheral surface thereof, it can be said that the drum always faces the induction module with the same area and the same distance regardless of the rotation angle thereof.

However, the area and the distance by which the drum faces the induction module necessarily vary according to the rotation angle of the drum. The reason that the area and the distance by which the drum faces the induction module necessarily vary according to the rotation angle of the drum is due to the presence or absence of the embossing patterns or variation in the embossing patterns described above. That is, the shape of the drum that faces the induction module may inevitably vary.

Figure 8:
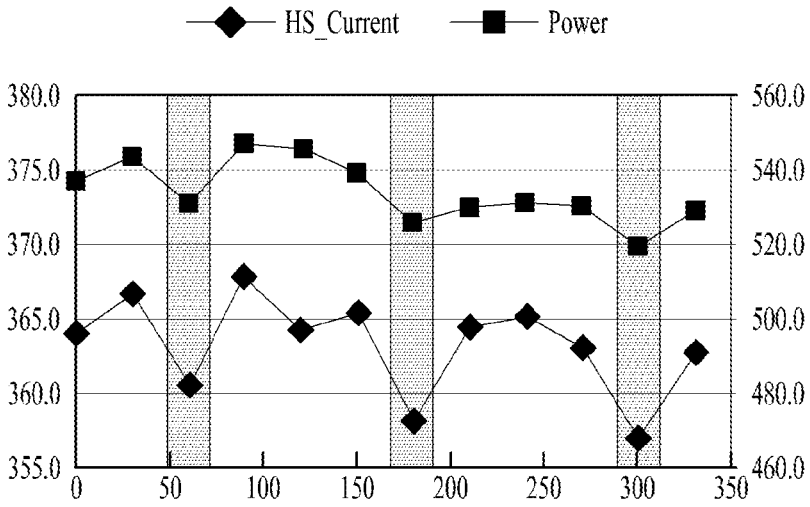
FIG. 8 illustrates a change in the current and output (power) of the induction module depending on the rotation angle of the drum with respect to the inner peripheral surface of the drum illustrated in FIG. 7.

FIG. 8 illustrates changes in the current and output of the induction module 70 depending on the rotational angle of the drum.

It can be seen that the current and the output of the induction module vary according to the rotation angle of the drum. In other words, it can be seen that the current and the output are greatly reduced at a specific point in time or at a specific angle.

The position of the lifter may be estimated without a separate sensor based on a change in the current sensed in the induction module or a change in the output of the induction module. For example, the current or output of the induction module may vary when the drum rotates while the induction module maintains a constant output.

In the state in which the induction module is controlled to have the same current or output via feedback control, the current or the output is reduced when the portion of the drum in which the lifter is mounted faces the induction module. This is because the area and the distance by which the drum faces the induction module may become the shortest at the corresponding portion. Therefore, the position of the lifter mounting portion may be estimated based on a change in the current or the output (power) of the induction module depending on a change in the rotation angle of the drum.

By estimating the position of the lifter mounting portion, the output (power) of the induction module at the lifter mounting position may be controlled to be 0, or may be significantly reduced.

Referring to FIG. 8, it can be estimated that the lifters are positioned respectively in the section of approximately 50-70 degrees, in the section of approximately 170-190 degrees, and in the section of approximately 290-310 degrees based on 360 degrees. For example, it can be estimated that the lifters are positioned in three angular sections while the induction module starts to drive and the drum rotates one revolution. Of course, in order to more accurately grasp the positions of the lifters, the positions of the lifters may be corrected by repeating the same process multiple times.

Then, when the estimation of the positions of the lifters is complete, the output of the induction module may be variably controlled based on the positions of the lifters during a subsequent drum rotation.

Through the embodiments described with reference to FIGS. 4 to 8, the heating efficiency may be enhanced and overheating of the lifter may be prevented without special modifications of the drum or the lifter.

Figure 9:
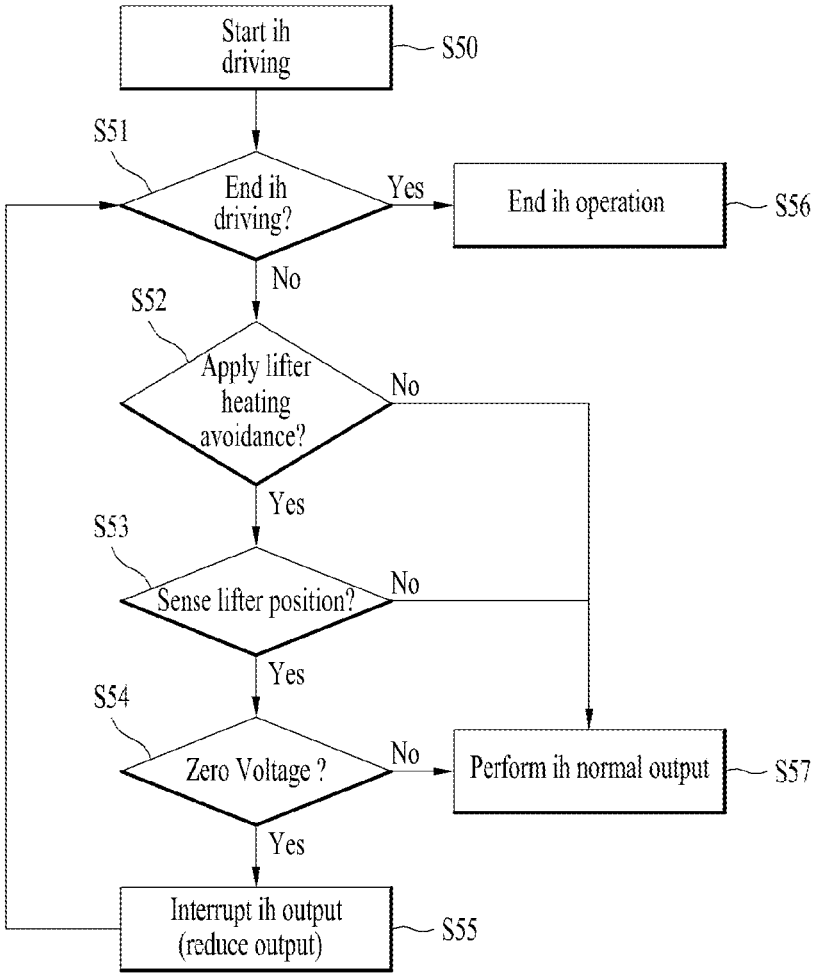
FIG. 9 illustrates a control flow according to an embodiment of the present invention.

Hereinafter, a control method according to an embodiment of the present invention will be described in detail with reference to FIG. 9.

First, driving of the induction module 70 starts (S50) in order to heat the drum as needed. This drum heating may be performed in order to dry the laundry inside the drum or to heat the wash water inside the tub. Thus, the induction module 70 may be driven when a drying operation or a washing operation is performed. The induction module 70 may also be driven during a dehydration operation. In this case, since the drum rotates at a very high speed, the drum heating amount may be relatively small, but the dehydration effect may be further enhanced since the removal of water by centrifugal force and the evaporation of water by heating are performed in a complex manner.

Once driving of the induction module 70 has started, it is determined whether or not an end condition is satisfied (S51). When the end condition is satisfied, the driving of the induction module 70 ends (S56). The end condition may be the end of the washing operation, or may be the end of the drying operation. However, the end of the driving S56 may be a temporary end, rather than a final end in one washing course or drying course. Thus, the induction module may be repeatedly turned on and off.

Once driving of the induction module 70 has started, the induction module 70 may be controlled to perform normal output until the driving of the induction module 70 ends (S56). That is, the induction module 70 may be controlled to have a predetermined output, and may be controlled via feedback for more accurate output control. Thus, the driving of the induction module 70 may include controlling the induction module to the normal output in by module controller.

In order to solve the overheating problem in the portion in which the lifter is mounted, the control method may include sensing the position of the lifter when the drum rotates S53. Specifically, it may be determined whether or not the lifter is positioned so as to face the induction module (i.e. whether or not the lifter faces the induction module at the closest position). The sensing of the position of the lifter may be continuously performed while the drum is being driven. Of course, the induction module may not be continuously driven while the drum is being driven. For example, in a rinsing operation, the drum may be driven, but the induction module may not be driven. In addition, although the driving of the drum is continued in a washing operation, which is subsequently performed after the heating of wash water ends, the induction module may not be driven.

Therefore, the position of the lifter may be detected after the induction module is driven. That is, the detection of the position of the lifter may be performed under the assumption that driving of the induction module starts.

Once the position of the lifter has been detected, it may be determined whether or not the lifter is at a specific position. That is, it is determined whether the output is to be reduced or to be set to 0 (S54). When it is detected that the lifter is positioned to face the induction module, a condition under which the output is reduced or becomes zero is satisfied. Thus, the output of the induction is reduced or is set to 0 (S55). On the other hand, when it is detected that the lifter is not positioned to face the induction module, the induction module is maintained at the normal output (S57).

By repeating the steps described above, the output of the induction module may be controlled so as to be reduced when the lifter is positioned to face the induction module, and may be controlled to perform normal output when the lifter is not positioned to face the induction module. Thus, it is possible to prevent overheating of the lifter mounting portion and increase energy efficiency by a controllable method.

The control of the output of the induction module depending on the position of the lifter may not always be performed. That is, while the drum is driven and the induction module is driven, the output may be continuously maintained at a constant value regardless of the position of the lifter. That is, the control described above may be omitted when the risk of overheating of the lifter may be ignored.

To this end, it may be determined whether or not the sensing of the position of the lifter and the control of the output of the induction module are required in order to avoid overheating of the lifter (S52). This determination may be performed before sensing the position of the lifter.

For example, when the drum rotates at a high rotation speed, for example, 200 RPM or more, the drum heating amount generated in the lifter mounting portion is relatively small because of the high rotational speed of the drum. Of course, the drum rotation speed is so high that the area and time of contact between the drum and laundry are relatively large. This is because, in this case, the laundry is not moved by the lifter, but is in close contact with the inner peripheral surface of the drum.

That is, the control of the drum heating amount depending on the position of the lifter may be meaningless at a specific RPM or more at which the drum is spin-driven, rather than driven to perform tumbling.

Accordingly, the determination of whether or not to apply a lifter heating avoidance logic S52 may be very effective. Of course, the conditions applied at this step may include various other conditions as well as the RPM. For example, when the drum is heated in a drying operation, a great amount of heat is transferred to the laundry. Thus, overheating may occur in a portion of the lifter that is not in contact with the laundry. On the other hand, when the drum is heated in the state in which wash water is accommodated in the tub and a portion of the outer peripheral surface of the drum is immersed in the wash water, heat is mostly transferred to the wash water. This may be true of the lifter exclusion portion as well as the lifter mounting portion.

Therefore, the condition for determining whether or not to apply the lifter heating avoidance logic may be a process of determining the type of an operation. The lifter heating avoidance logic may not be applied when a washing operation is determined. Thus, the conditions for applying the lifter heating avoidance logic may be variously modified.

Meanwhile, the sensing of the position of the lifter S50 may be performed in various ways. For example, the sensor and magnet described above may be used, or a change in the current or the output of the induction module may be used without a sensor.

Due to the positional relationship between the induction module and the drum and the shapes of the induction module and the drum, the induction module substantially heats only a specific portion of the drum. Thus, when the induction module heats the drum that is in a stopped state, only a specific portion of the drum may be heated to a very high temperature. For example, when the induction module is located on the upper portion of the tub and the drum does not rotate, only the outer peripheral surface of the upper portion of the drum may be heated when the induction module is driven.

In the state in which the drum is in the stopped state, the outer peripheral surface of the upper portion of the drum is not in contact with the laundry. Thus, the outer peripheral surface of the upper portion of the drum may be extremely overheated. Therefore, in order to prevent the drum from overheating, it is necessary to rotate the drum. That is, it is necessary to change the portion to be heated via rotation of the drum, and to transfer the heat to the wash water or to the laundry.

Therefore, in order to operate the induction module, the drum may need to rotate.

Hereinafter, an embodiment of the control logic between the operation of the induction module and the driving of the drum will be described with reference to FIG. 10.

A drum heating mode for heating the drum 30 may be performed during a washing operation or a drying operation, as described above. Substantially, the drum heating mode may be continuously performed during the washing operation and the drying operation.

When the drum heating mode S10 is performed, it may be determined whether or not a heating end condition is satisfied (S20). The heating end condition may be any one of a heating duration, a target drum temperature, a target drying degree, and a target wash water temperature. The heating mode ends when any one condition is satisfied (S70).

For example, the drum heating mode S10 may be continued so as to heat the wash water to 90 degrees in the washing operation. The drum heating mode S10 may end when the wash water reaches 90 degrees. The drum heating mode S10 may be continued until the degree of drying is satisfied in the drying operation.

In a washing machine or a drying machine, the drum is generally driven at a rotational speed at which tumbling driving is possible. The drum is directly accelerated to a speed at which the drum undergoes tumbling driving immediately from the stopped state of the drum. Then, the tumbling driving may be realized by forward and reverse rotation. That is, after continuing tumbling driving in the clockwise direction, the drum may stop and then again perform tumbling driving in the counterclockwise direction.

When the rotational speed of the drum is very low, a specific portion of the drum may likewise be overheated. For example, when the tumbling driving speed is 40 RPM, it takes a predetermined time until the drum is accelerated from the stopped state to 40 RPM. Thus, a point in time at which the drum starts tumbling driving differs from a point in time at which the drum performs normal tumbling driving. That is, when the drum starts tumbling driving, the drum is gradually accelerated from the stopped state to reach the tumbling RPM and is then driven at the tumbling RPM. The drum may perform tumbling driving in a predetermined direction, and then may stop and again perform tumbling driving in the other direction.

Here, there is a need to prevent overheating of the drum and to increase heating energy efficiency and time efficiency.

Avoiding heating for a period during which the RPM of the drum is very low may be good in terms of drum overheating prevention. Conversely, heating the drum only after the drum reaches a normal RPM may waste time.

Therefore, the point in time at which the induction module starts to operate may be after the drum starts to rotate and before the drum reaches the normal tumbling RPM. Of course, when avoiding the overheating of the drum is more important than the heating efficiency, the induction module may be operated after the drum reaches the tumbling RPM. Therefore, there is a requirement to strike a balance between heating efficiency and prevention of overheating.

For example, when the drum RPM is greater than 30 RPM, the induction module may be operated. That is, the drum RPM condition may be determined (S40), and when the condition is satisfied, the induction module may be turned on (S50). When the drum RPM is less than 30 RPM, the induction module may not be operated. That is, the induction module may be turned off (S60). That is, the induction module may be turned on based on a specific RPM, which is smaller than the tumbling RPM and greater than 0 RPM.

That is, the induction module may be operated only when the drum RPM is greater than a specific RPM, and may not be operated when the drum RPM is less than the specific RPM.

Therefore, for a normal tumbling driving period, the induction module may be driven after the drum starts to rotate and the driving of the induction module stops before the rotation of the drum stops. That is, the induction module may be turned on and off based on a threshold RPM, which is less than the normal tumbling RPM. Therefore, when the tumbling driving period is repeated a plurality of times, the induction module is repeatedly turned on and off.

In the present embodiment, a drum temperature condition may be determined in order to prevent overheating of the drum (S30). Of course, the drum temperature condition may be applied alone or in combination with the above-mentioned drum RPM condition. When the two conditions are applied together, the order of determination of these conditions may change. In FIG. 10, the case in which the determination of the drum temperature condition is performed first is illustrated.

As described above, the central portion of the drum is heated to a relatively higher temperature than the front and rear portions of the drum. For example, the central portion of the drum may be heated to around 140 degrees Celsius. Here, when the central portion of the drum is heated to 160 degrees Celsius or more, it may be determined that the drum is overheated. Of course, the drum temperature condition for the determination of overheating may change.

The temperature of 160 degrees Celsius may be a threshold temperature for preventing thermal deformation of elements around the drum and damage to laundry. Thus, when the drum temperature is equal to or greater than the threshold temperature, the induction module may be turned off (S60).

Figure 10:
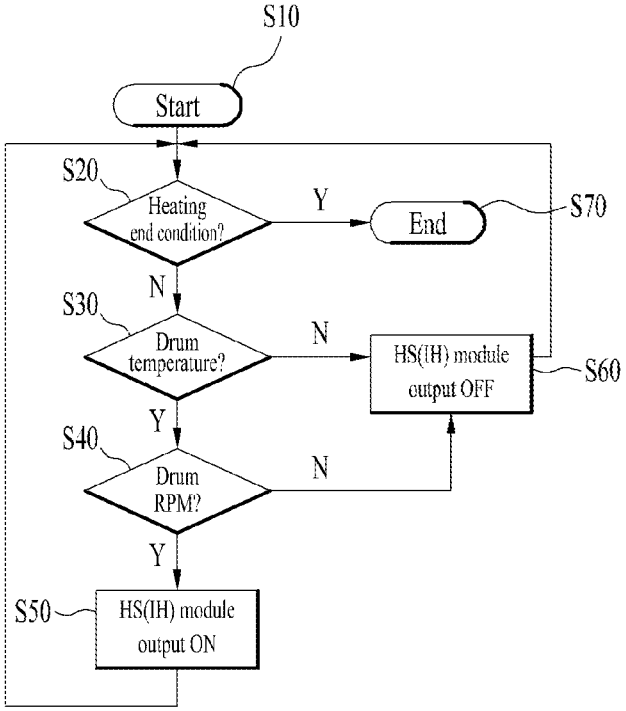
FIG. 10 illustrates a control flow according to an embodiment of the present invention.

Accordingly, in the embodiment illustrated in FIG. 10, for example, assuming that the drum temperature is less than 160 degrees, the rotational speed of the drum is 40 RPM, and the target wash water temperature is 90 degrees Celsius, but that the current temperature of the wash water is 40 degrees Celsius, the induction module may be in the ON state. Therefore, reliability may be guaranteed and safe drum heating may be realized through various conditions.

Meanwhile, variable control of the induction module may be performed when the induction module is in the ON state. Thus, the variable control of the output of the induction module may be performed in the induction module ON step S50. An embodiment of the variable control of the output has been described above with reference to FIG. 9. In this way, when the tumbling driving is continued, the induction module may repeatedly undergo a normal output period and a reduced output period.

Accordingly, the control logic for the drum heating mode and the control logic for the prevention of overheating of the lifter may be implemented in a complex manner. Therefore, it is possible to prevent the drum from overheating, to quickly stop the heating of the drum in case of unexpected drum overheating, and to prevent overheating of the lifter.

Hereinafter, an embodiment of a temperature sensor 60 for sensing the temperature of the drum will be described in detail with reference to FIG. 11.

The object to be heated by the induction module 70 is the drum 30. Therefore, the drum 30 may be an element in which overheating may directly occur. When the drum 30 is heated to heat wash water, the temperature of the drum 30 is much higher than the boiling temperature of the wash water. This may be attributed to the characteristics of the induction heater.

However, the drum 30 is configured to rotate. In addition, as described above, the drum may be heated only while the drum is rotating.

Therefore, it is not easy to sense the temperature of the drum due to the specific characteristics of the drum, and furthermore, it is not easy to sense the temperature of the drum at the time of rotation. In particular, it is not easy to sense the temperature of the drum at the central portion of the drum (i.e., a portion of the outer peripheral surface at the middle between the front and rear ends of the drum) having the highest temperature.

The temperature of the drum may be measured in a direct manner. For example, it is possible to directly measure the temperature of the drum using a non-contact type temperature sensor. For example, the temperature of the outer peripheral surface of the drum may be sensed through an infrared temperature sensor.

However, since the drum is configured to rotate as described above and is provided inside the tub, the environment inside and outside the drum may be a high temperature and high humidity environment. Therefore, it is very difficult to detect the temperature of the drum by irradiating the outer peripheral surface of the drum with infrared rays. This is because the infrared rays may be scattered by water vapor.

Due to this difficulty, the inventors of the present invention have attempted to indirectly measure the temperature of the drum rather than directly measuring the temperature of the drum. That is, the inventors have attempted to indirectly measure the temperature of the drum using an air temperature value depending on the generation of heat in the drum.

The gap between the outer peripheral surface of the drum and the inner peripheral surface of the tub may be approximately 20 mm. Therefore, it may be possible to indirectly measure the temperature of the drum by measuring the temperature of air between the outer peripheral surface of the drum and the inner peripheral surface of the tub.

The temperature sensor 60 mounted on the inner peripheral surface of the tub 20 may be provided to sense the temperature of air between the inner peripheral surface of the tub and the outer peripheral surface of the drum. Thus, the difference between the actual temperature of the outer peripheral surface of the drum and the air temperature (the temperature sensed by the temperature sensor) may be obtained by multiplying the amount of heat transferred by the air (between the outer peripheral surface of the drum and the temperature sensor) by the heat resistance of the air.

When constant air flow is generated on the outer peripheral surface of the drum by the rotation of the drum, the difference between the temperature of the outer peripheral surface of the drum and the air temperature measured inside the tub may be constant. Therefore, the temperature of the outer peripheral surface of the drum may be estimated as the sum of a constant and the measured temperature value.

Therefore, it is possible to control the driving of the induction module based on the estimated temperature of the outer peripheral surface of the drum.

Here, in order to more accurately estimate the temperature of the outer peripheral surface of the drum, it may be necessary to exclude, as much as possible, external environmental factors that cause an increase/decrease in the temperature between the outer peripheral surface of the drum and the temperature sensor.

Of course, most of these external environmental factors act to lower the temperature of the drum.

For example, accurate temperature estimation may be difficult when airflow due to rotation of the drum and airflow due to other elements increase.

For example, in a portion into which cooling water is introduced, accurate temperature estimation may be difficult because heat in the drum is mainly transferred to the cooling water.

For example, in a portion that is in direct communication with a relatively low temperature environment outside the tub, heat in the drum may be mainly transferred to the outside of the tub.

For example, when the temperature sensor is provided at a portion affected by the magnetic field of the induction module, accurate temperature measurement may be difficult.

Therefore, the position at which the temperature sensor is mounted may be very limited. This is because various factors, such as precise temperature measurement, temperature measurement for the highest temperature portion of the drum, and avoidance of interference with a tub connection portion (a portion in which the front portion and the rear portion of the tub are connected to each other) due to the structure of the tub, need to be considered.

Figure 11:
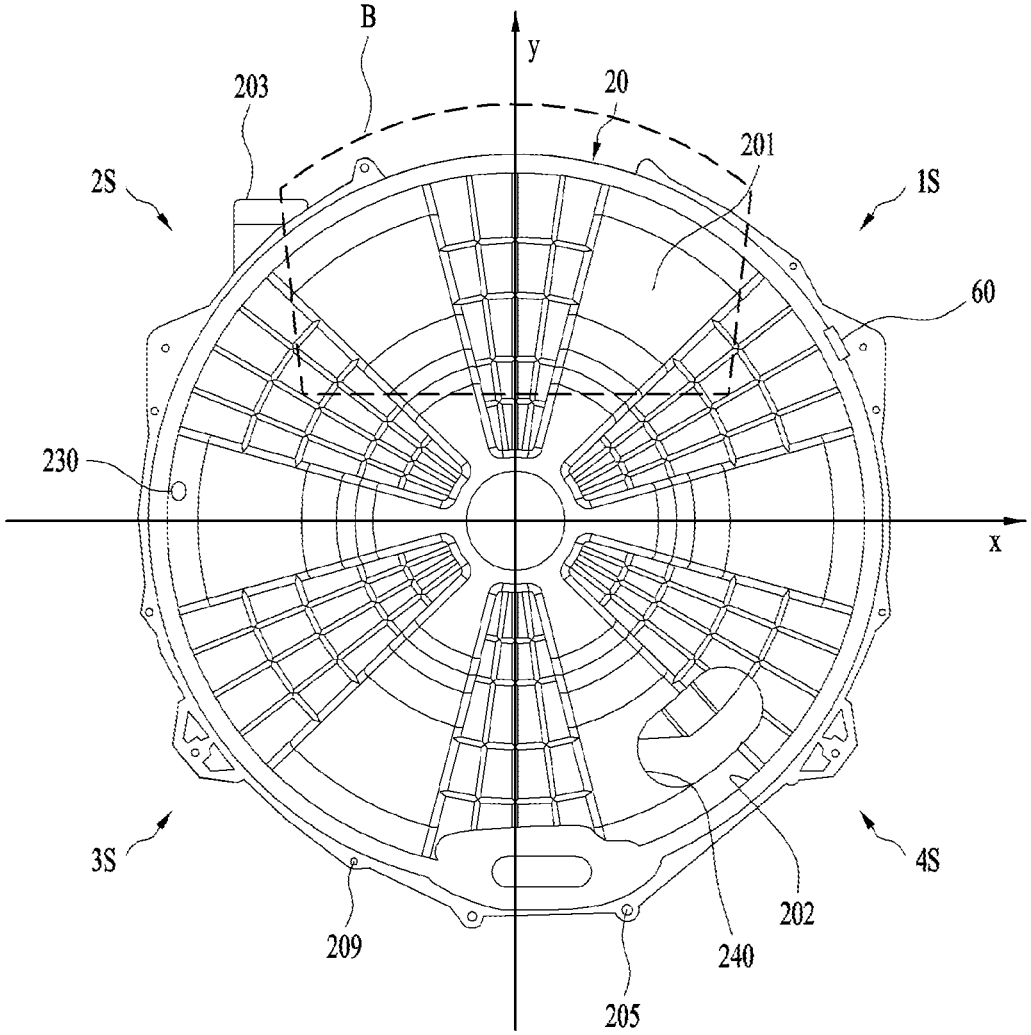
FIG. 11 illustrates a magnetic field area of the induction module and the position of a temperature sensor in the transverse cross section of the tub.

FIG. 11 illustrates a cross section illustrating the mounting position of the temperature sensor 60 according to an embodiment of the present invention. FIG. 11 illustrates an inner rear wall 201 and an inner sidewall 202 of the tub in the transverse cross section of the tub 20.

First, as described above, the induction module 70 may be located on the upper portion of the tub 20. When the cross section of the tub is divided into four quadrants, the induction module 70 may be located on a first quadrant 1S or a second quadrant 2S. Of course, the induction module 70 may be located on both the first and second quadrants 1S and 2S. In either case, the induction module 70 may be located above the vertical center axis of the tub.

The second quadrant S2 of the tub 20 may be generally provided with an airflow hole 203. That is, the inside of the tub may be in communication with the outside of the tub through the airflow hole 203, rather than being completely sealed with respect to the outside of the tub. Therefore, the second quadrant 2S of the tub 20 corresponding to the airflow hole 203 is affected by the outside air having a relatively low temperature. Of course, the airflow hole 203 may be provided in the first quadrant S1 of the tub 20 as occasion demands.

A condensing port 230 may be provided in or near the third quadrant 3S of the tub 20 to cool the heated wet air so as to condense water. That is, the condensing port 230 may be provided to supply the cooling water from the outside of the tub to the inside of the tub so as to cool the heated wet air inside the tub. The inside of the tub corresponding to the third quadrant 3S, to which the cooling water is supplied, is influenced by low-temperature condensate water.

A fourth quadrant 4S of the tub 20 may be provided with a duct hole 202, through which the air inside the tub is discharged to the outside. The air, from which the water is removed by the cooling water, is discharged from the inside of the tub to the outside of the tub 20 through the duct hole 202. Of course, the discharged air may again be introduced into the tub 20.

Accordingly, the temperature of the inside of the tub corresponding to the duct hole 202, i.e., the fourth quadrant 4S is lower than that of the other portions, and the flow of air is accelerated.

Of course, the positions of the condensing port 230 and the duct hole 202 may be opposite each other.

Meanwhile, air has a tendency to be lowered in density when heated. Therefore, the temperature sensor may be provided in the first quadrant 1S and the second quadrant 2S, but not in the fourth quadrant 4S and the third quadrant 3S of the tub. This is because the temperature of the air in the first and second quadrants of the tub is expected to be higher than the air temperature in the fourth and third quadrants of the tub. In addition, due to the condensed water from the condensing port 230 and the outside air from the duct hole 202, the air in the third and fourth quadrants is relatively low in temperature, which makes it impossible to accurately estimate the temperature of the drum.

In particular, considering the configuration of the airflow hole 203, the condensing port 230, and the duct hole 202, it can be seen that the optimum temperature sensor position is the first quadrant 1S. Of course, when the airflow hole 203 is provided in the second quadrant, the optimal temperature sensor position may be the second quadrant.

When the temperature sensor 60 is provided in the first quadrant 1S, the temperature sensor 60 may be mounted at a position offset from the center of the tub in the circumferential direction by a greater predetermined angle than that in the induction module 70. This is because it may be necessary to prevent the magnetic field generated in the induction module 70 from affecting on the temperature sensor 60. In FIG. 11, the area of influence of the magnetic field is indicated by "B". Thus, the temperature sensor 60 may be mounted on the inner peripheral surface of the tub in the first quadrant 1S of the tub outside the area "B".

The area "B" may be substantially the area to which the coil of the induction module 70 is projected. The size of the induction module 70 may be greater than the size of the coil. Thus, the temperature sensor may be mounted in the vicinity of the induction module 70 or in the end portion of the induction module 70 in the circumferential direction. That is, the temperature sensor may be provided outside the projection area of the coil in the circumferential direction.

In addition, the temperature sensor 60 may be positioned so as to be farther away from the airflow hole in the clockwise direction. Conversely, when the airflow hole is provided in the second quadrant, the temperature sensor 60 may be mounted at a position that is spaced apart from the airflow hole in the counterclockwise direction.

FIG. 11 illustrates a connection portion 209 in which the front portion and the rear portion of the tub are coupled to each other via bolts or screws. The connection portion 209 is formed so as to protrude radially outward from the outer peripheral surface of the tub. Thus, the temperature sensor may be located in front of or behind the connection portion 209 in order to avoid interference with the connection portion 209.

As a result, it can be seen that the position of the temperature sensor is located in the first quadrant 1S of the transverse cross section of the tub and has a positive value with respect to the x and y axes. Of course, when the airflow hole is provided in the first quadrant, the position of the temperature sensor may be the second quadrant. In addition, it can be seen that the temperature sensor may be located in front of or behind the connection portion 209 near the center of the tub in the longitudinal direction of the tub. Therefore, the temperature sensor may be mounted at substantially the center position of the induction module in the longitudinal direction, so that the portion of the drum having the highest temperature may be accurately sensed.

Figure 6:
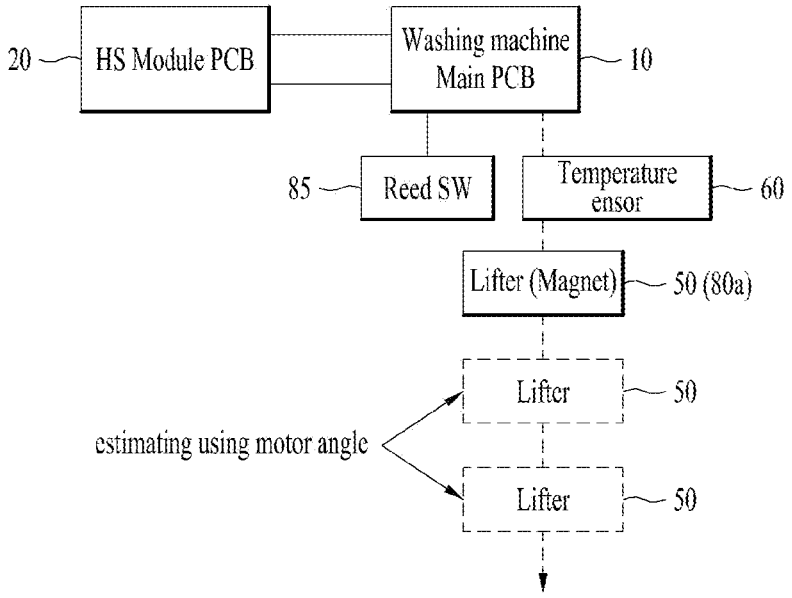
FIG. 6 illustrates a block diagram of another embodiment of the control elements.

FIGS. 5 and 6 illustrate an example in which the temperature sensor 60 is connected to the main controller 100. That is, the main controller 100 performs a process of estimating the temperature of the drum based on the temperature sensed by the temperature sensor 60. Thus, when the temperature of the drum is estimated, step S30 illustrated in FIG. 10 may be performed based thereon.

Alternatively, the temperature sensor 60 may separately perform a process of estimating the temperature of the drum. That is, the temperature sensor 60 may be formed in the form of an assembly or module having a separate processor. In this case, the drum temperature estimated by the temperature sensor 60 may be transmitted to the main controller 100.

Meanwhile, step S30 may be performed by the module controller 200, rather than by the main controller 100. In either case, when the temperature of the drum exceeds a threshold temperature, overheating of the drum may be recognized and the output of the induction module may be interrupted.

Through the above-described embodiments, it can be seen that control logic for preventing overheating of the drum, control logic for preventing overheating of the lifter, the temperature sensor for preventing the drum from overheating, and control logic using the temperature sensor may provide a laundry treatment apparatus having enhanced safety and reliability. In addition, it can be seen that the temperature sensor capable of more accurately sensing the temperature of the drum in an indirect manner and the mounting position of the temperature sensor may be provided.

Features in each of the above-described embodiments may be implemented in a combined manner in other embodiments as long as they are not contradictory or exclusive of each other.

As is apparent from the above description, according to an embodiment of the present invention, it is possible to provide a laundry treatment apparatus that effectively prevents overheating from occurring in a lifter provided in a drum, thereby enhancing safety and a method of controlling the same. In particular, it is an object to provide a laundry treatment apparatus that faithfully maintains the basic functions of a lifter and enhances stability and a method of controlling the same.

According to an embodiment of the present invention, it is possible to provide a laundry treatment apparatus that is capable of preventing overheating from occurring in a portion of a drum in which a lifter is mounted without changing the shapes of the drum and the lifter and a method of controlling the same.

According to an embodiment of the present invention, it is possible to provide a laundry treatment apparatus that is capable of grasping the position of a lifter and reducing the amount of heat generated in a portion of the circumferential surface of a drum corresponding to the lifter, thereby reducing energy loss and preventing breakage of the lifter and a method of controlling the same.

According to an embodiment of the present invention, it is possible to provide a laundry treatment apparatus that is capable of controlling the output of an induction module to prevent overheating of a lifter regardless of the rotation angle of a drum, thereby enhancing safety and efficiency and effectively utilizing the output of the induction module and a method of controlling the same.

According to an embodiment of the present invention, it is possible to provide a laundry treatment apparatus that is capable of uniformly heating a space in which laundry is accommodated by performing heating not only on a drum but also on a lifter. In particular, it is an object to provide a laundry treatment apparatus that is capable of preventing overheating of a lifter by lowering the heating temperature of a portion of a drum in which the lifter is mounted relative to that of a remaining portion of the drum in which the lifter is not mounted and capable of increasing heating efficiency by allowing heat transfer through the lifter and a method of controlling the same.

According to an embodiment of the present invention, it is possible to provide a laundry treatment apparatus that is enhanced in stability and efficiency while minimizing changes in the shape and structure of a conventional drum and lifter and a method of controlling the same.

According to an embodiment of the present invention, it is possible to provide a laundry treatment apparatus that is capable of preventing unintended overheating of a drum by reliably sensing the temperature of the drum that is being rotated and a method of controlling the same.

According to an embodiment of the present invention, it is possible to provide a laundry treatment apparatus equipped with a temperature sensor at a position at which the temperature of a drum may be optimally sensed with minimal influence from the external environment.

According to an embodiment of the present invention, it is possible to provide a laundry treatment apparatus that is capable of effectively preventing overheating of a drum while increasing heating efficiency.

What is claimed is:

1. A laundry treatment apparatus comprising:

a tub;

a drum disposed within the tub and configured to accommodate laundry therein, the drum being made of a metal material;

an induction module arranged on an outer peripheral surface of an upper portion of the tub and configured to heat the drum via induction using a magnetic field; and a controller configured to control an output of the induction module, wherein the controller is configured to:

turn on the induction module based on a rotational speed of the drum reaching a threshold revolutions per minute (RPM) after the drum starts to rotate, and turn off the induction module based on the rotational speed of the drum falling to less than the threshold RPM.

2. The laundry treatment apparatus according to claim 1, wherein the induction module is mounted over at least one of a first upper quadrant or a second upper quadrant of the tub based on a transverse cross section of the tub.

3. The laundry treatment apparatus according to claim 2, further comprising a temperature sensor that is disposed at a position spaced apart from a projection area of a coil of the induction module.

4. The laundry treatment apparatus according to claim 3, wherein the tub has an airflow hole for air flow between an inside of the tub and an outside of the tub, the airflow hole being defined on the upper portion of the tub, wherein the temperature sensor is provided at a position spaced apart from the airflow hole in a circumferential direction of the tub, and wherein the induction module is positioned between the airflow hole and the temperature sensor in the circumferential direction of the tub.

5. The laundry treatment apparatus according to claim 1, wherein the tub further comprises:

a duct hole provided at a lower portion of the tub and configured to discharge or circulate air that is inside of the tub to an outside of the tub; and a condensing port positioned opposite to the duct hole about a vertical center axis of the tub and configured to supply cooling water to the inside of the tub.

6. The laundry treatment apparatus according to claim 4, wherein the temperature sensor is configured to sense an air temperature in a space defined between an inner circumferential surface of the tub and an outer circumferential surface of the drum.

7. The laundry treatment apparatus according to claim 1, further comprising at least one processor that is configured to receive a temperature of the drum based on an air temperature in the tub that is sensed by a temperature sensor.

8. The laundry treatment apparatus according to claim 7, wherein the controller is configured to turn off driving of the induction module based on the temperature of the drum exceeding a threshold temperature.

9. The laundry treatment apparatus according to claim 1, wherein the threshold RPM is less than a tumbling RPM for a tumbling driving of the drum.

10. The laundry treatment apparatus according to claim 5, wherein the vertical center axis of the tub passes through the induction module located on the upper portion of the tub.

11. The laundry treatment apparatus according to claim 9, wherein the threshold RPM is 30 RPM.

12. The laundry treatment apparatus according to claim 9, wherein the controller is configured to not operate the induction module based on the rotational speed of the drum being less than 30 RPM.

13. The laundry treatment apparatus according to claim 1, wherein the controller is configured to maintain the induction module in an on state based on the drum rotating in a spin mode.

14. The laundry treatment apparatus according to claim 1, wherein the controller is configured to operate the induction module based on the drum rotating in a tumbling driving mode.

15. The laundry treatment apparatus according to claim 1, further comprising:

a magnet provided on the drum, and a sensor provided on the tub and configured to sense the magnet based on rotation of the drum.

16. The laundry treatment apparatus according to claim 15, wherein the drum comprises a group of lifters that are arranged along a circumferential direction of the drum and that are spaced apart from one another, and wherein the magnet is provided between two lifters of the group of lifters.

17. The laundry treatment apparatus according to claim 16, wherein the magnet comprises a plurality of magnets, a number of the plurality of magnets being equal to a number of the lifters, and wherein each of the plurality of magnets is provided between the lifters.

18. The laundry treatment apparatus according to claim 15, wherein the controller is configured to repeatedly turn off the induction module based on the sensor sensing the magnet while the drum rotates.

19. The laundry treatment apparatus according to claim 16, wherein the lifters are made of a plastic material.

20. The laundry treatment apparatus according to claim 15, wherein the sensor is provided at a lowermost portion of the tub.

21. A laundry treatment apparatus comprising:

a tub;

a drum disposed within the tub and configured to accommodate laundry therein, the drum being made of a metal material and including lifters;

an induction module arranged on an outer peripheral surface of an upper portion of the tub and configured to heat the drum via induction using a magnetic field;

a magnet provided on the drum and disposed between two lifters of the lifters;

a sensor provided on a lower portion of the tub and configured to sense the magnet while the drum is rotating; and a controller configured to control an output of the induction module, wherein the controller is configured to turn on the induction module based on the drum starting to rotate.

22. The laundry treatment apparatus according to claim 21, wherein the magnet comprises a plurality of magnets, a number of the plurality of magnets being equal to a number of the lifters, and wherein each of the plurality of magnets is provided between the lifters.

23. The laundry treatment apparatus according to claim 21, further comprising:

a processor configured to control driving of the drum and a rotational speed of the drum.

24. The laundry treatment apparatus according to claim 21, wherein the controller is configured to turn on the induction module based on the drum rotating with a rotational speed greater than 30 RPM.

25. The laundry treatment apparatus according to claim 24, wherein the controller is configured to not operate the induction module based on the rotational speed of the drum being less than 30 RPM.

26. The laundry treatment apparatus according to claim 21, wherein the controller is configured to maintain the induction module in an on state based on the drum rotating in a spin mode.

27. The laundry treatment apparatus according to claim 21, wherein the controller is configured to turn on and off the induction module based on the drum rotating in a tumbling driving mode.

* * * * *